United States Patent [19]

Uyeda

[11] 4,222,251

[45] Sep. 16, 1980

[54] ADDITIONAL LOCKING SYSTEM FOR COMBINATION LOCK

[75] Inventor: Tim M. Uyeda, South San Gabriel, Calif.

[73] Assignees: Klaus W. Gartner, La Palma; Peter J. Phillips, Redondo Beach, both of Calif. ; a part interest

[21] Appl. No.: 940,755

[22] Filed: Sep. 8, 1978

[51] Int. Cl.[2] ..... E05B 63/00

[52] U.S. Cl. ..... 70/1.5; 70/416; 70/333 R

[58] Field of Search ..... 70/1.5, 1.7, 333, 416; 292/144, 201; 49/7; 109/30

[56] References Cited

U.S. PATENT DOCUMENTS

| | | | |
|---|---|---|---|
| 1,622,608 | 3/1927 | Peterson | 70/1.7 |
| 1,691,030 | 11/1928 | Benham | 70/1.5 |
| 3,111,022 | 11/1963 | Maynard | 70/1.5 |

*Primary Examiner*—Robert L. Wolfe

*Attorney, Agent, or Firm*—Poms, Smith, Lande & Rose

[57] ABSTRACT

An additional locking system is provided for a combination lock. The combination lock includes a housing, a locking mechanism and a bolt in the housing movable between a first position projecting out of the housing and a second position generally withdrawn in the housing. The bolt can be moved to the second position only when the locking mechanism is in an unlocked condition. The additional locking system provides an additional lock for the bolt in the first position, and a heat responsive member prevents the additional locking system from locking the bolt until the housing is heated above a predetermined temperature. The additional locking system includes a spring with an arm thereon in the housing. The bolt includes a slot and the spring is mounted such that the arm is adjacent the slot, and the spring biases the arm toward the slot. The heat responsive member is a fuse in the housing urging the spring against the biasing to hold the arm out of the slot. When the fuse is melted when heat above a predetermined temperature is applied to the housing, the fuse no longer holds the spring against the biasing so that the spring can move the arm into the slot.

6 Claims, 6 Drawing Figures

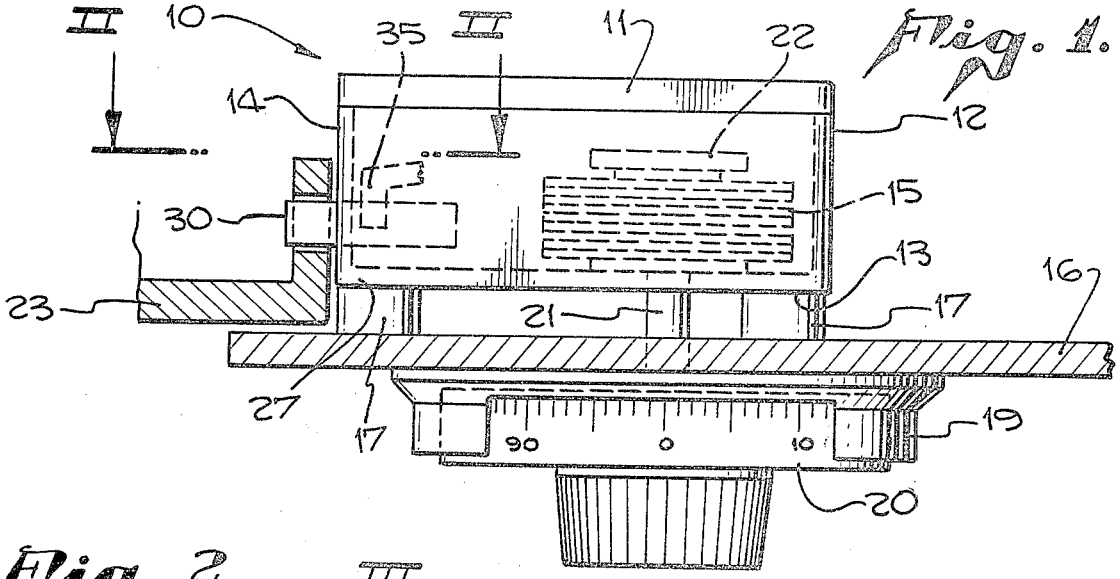
Fig. 1.
Fig. 2.
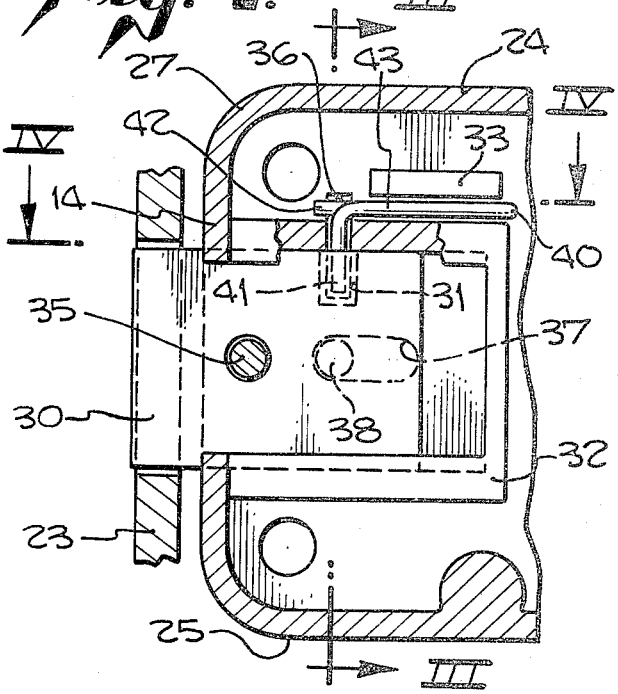
Fig. 4.
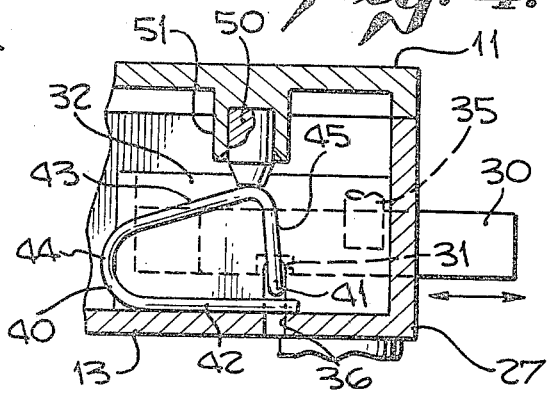
Fig. 5.
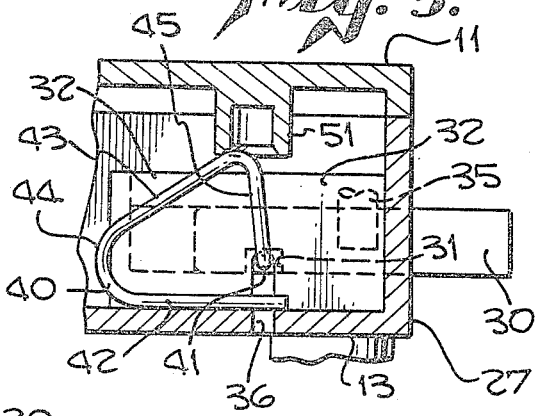
Fig. 3.
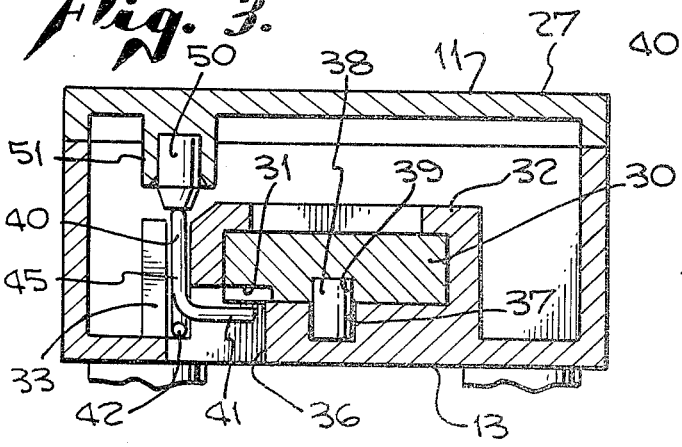
Fig. 6.
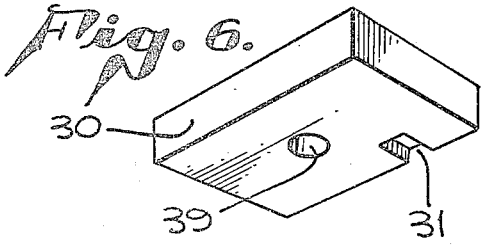

ADDITIONAL LOCKING SYSTEM FOR COMBINATION LOCK

BACKGROUND OF THE INVENTION

There have been many improvements in the combination portions of combination locks to make them more secure. However, the improvements have been mainly directed to improving the combination mechanism so that the lock resists manipulations to ascertain alignment of tumbler gates. Normally, the manipulations are either by sound or feel, and one attempting surreptitious entry into the safe attempts through certain techniques to dial the lock combination.

Manipulative techniques using either sound or feel are difficult and time consuming. Many attempt to physically enter the lock housing in order to gain access to the tumblers and the linkage to the bolt. The most common methods are either by drilling or by use of an acetylene cutting torch. For example, it is a common technique to cut into the housing to reach the linkage between the tumblers and the bolt. By moving the linkage, the bolt can be withdrawn into the housing and the safe can be opened.

One of the objects, therefore, of the present invention is to disclose and provide a combination lock which can be prevented from being unlocked when the case is entered by means of drilling or acetylene cutting. Specifically, one object of the present invention is to disclose and provide a mechanism which will lock the lock bolt independent of the tumblers when the housing is subjected to a predetermined temperature which would occur from an acetylene torch or from friction created during drilling. A further object of the present invention is to disclose and provide an additional locking mechanism which is difficult to tamper with even if partial access is gained to the inside of the cse. Still another object of the present invention is to disclose and provide such an additional locking mechanism that is easily assembled inside the lock housing, and which can be easily set when the housing is assembled.

Of course, it is an object of the present invention that the additional locking mechanism be both reliable and of low cost. The present invention meets the previously stated objects, and it also meets other objects that, although not specifically listed as objects, are evident from the description of the invention.

SUMMARY OF THE INVENTION

The present invention may be used in a combination lock of the type set forth in application Ser. No. 782,845 filed Mar. 30, 1977, now U.S. Pat. No. 4,142,385, to Phillips et al entitled "Tumbler Wheels for Combination Locks".

The combination lock which includes the improvement of the present invention comprises a housing, a locking mechanism and a bolt in the housing movable between a first position projecting out of the housing and a second position generally withdrawn in the housing. Means are provided for moving the bolt to the second position only when the locking mechanism is in an unlocked condition. The combination lock has been improved by providing additional locking means in the housing for locking the bolt in the first position, and heat responsive means for preventing the additional locking means from locking the bolt until the housing is heated above a predetermined temperature. The additional locking means includes an arm and biasing means for biasing the arm into engagement with the bolt to prevent movement of the bolt. The heat responsive means comprises a fuse which engages the biasing means to prevent the biasing means from urging the arm into engagement with the bolt. When the housing is heated above a predetermined temperature, the fuse melts to release its engagement with the biasing means to permit the biasing means to move the arm into engagement with the bolt. The bolt is provided with a slot, and the biasing means or spring is mounted in the housing such that the arm is adjacent the slot. The housing may also include a guard around the spring to prevent the spring from being removed from the position with the arm adjacent the spring.

The spring of the present invention includes a pair of legs interconnected at a bight portion and a third leg connected to one of the pair of legs. The arm depends from the third leg. All three legs are in the same plane, and the arm is in a plane perpendicular to the plane of the legs. One leg of the pair of legs is secured in the housing and the other leg of the pair of legs contacts the fuse. The spring is biased against the fuse, and it positions the third leg such that the arm is adjacent the slot. When the fuse melts, the other leg of the pair of legs is free to move so that the third leg can move to position the arm in the slot. The housing may include a removable rear wall to provide access to the housing interior. The fuse is mounted on the rear wall such that the fuse contacts the spring to move the leg out of the slot when the rear wall is secured to the housing.

The present invention also includes a method of providing an additional lock for a combination lock. The method includes the steps of biasing a spring in the lock toward the bolt of the combination lock such that when the spring is in the bolt, the bolt is prevented from moving. The fuse forces the spring out of the bolt, but when the fuse is subjected to at least a predetermined temperature and melts, the fuse releases the spring to allow it to enter the bolt.

BRIEF DESCRIPTION OF THE DRAWINGS

FIG. 1 is a plan view of the combination lock that includes the improvements of the present invention.

FIG. 2 is a sectional view taken through plane II—II in FIG. 1 and shows in some detail the structure included in the improvement of the present invention including the spring and its interaction with the bolt.

FIG. 3 is a sectional view taken through plane III—III of FIG. 2, and in addition to showing the bolt and spring, it shows the fuse and the guard means.

FIGS. 4 and 5 are sectional views taken through plane IV—IV of FIG. 2. In FIG. 4, the fuse is holding the spring away from the bolt, and in FIG. 5, the fuse is melted allowing the spring to engage the bolt.

FIG. 6 is a perspective view of the bolt used in the present invention.

DETAILED DESCRIPTION OF THE PREFERRED EMBODIMENT

The Combination Lock

The lock of the present invention is shown generally in FIG. 1 and is similar to that disclosed in the aforementioned co-pending application Ser. No. 782,845. Housing 10 has a plurality of tumblers 15 mounted therein. Housing 10 includes a rear wall 11, sidewalls 12 and 14 and front wall 13. Housing 10 is conventionally secured to door 16 and is spaced slightly apart there-from by spacers 17. Dial housing 19 is mounted to the other side of door 16 and dial 20 is mounted in the dial housing. Shaft 21 is attached at one end to driver 22 at the rear of the tumblers and at its other end to dial 20 in a manner set forth in greater detail in application Ser. No. 782,845.

As is conventional, rotation of dial 20 rotates shaft 21 which in turn rotates driver 22. By rotating the dial clockwise and counterclockwise, tumblers 15 can be aligned such that gates (not shown) on the tumblers are aligned. When that occurs, an arm drops into the gates allowing a linkage to enter a gripping portion on driver 22 (all of which is conventional and therefore not shown). See for exmaple Potzick, U.S. Pat. No. 3,386,275. Continued rotation of the driver pulls the linkage. The other end of the linkage is connected to bolt 30 at connection 35, and the linkage pulls bolt 30 to the right in FIG. 1. When bolt 30 is retracted inside housing 10, it disengages safe wall 23 allowing safe door 16 to be pivoted open. Rotation of driver 22 in the opposite direction causes the linkage to move bolt 30 to the left, thereby locking the lock.

Bolt 30 is mounted in bolt guide 32 to align it. The bolt guide includes a slot 37 which guides pin 38 in hole 39. Bolt guide 32 also has an opening 26 to allow access for the linkage to connection 35.

The previously described system is relatively conventional. The conventional system has been improved by providing additional locking means in the housing for locking the bolt in the first or extended position (FIG. 1) and heat responsive means for preventing the additional locking means from locking the bolt until the housing is heated above a predetermined temperature.

The Improvement

The additional locking means of the improvement of the present invention comprises a spring 40 mounted in the housing. In the exemplary embodiment, arm 41 (FIGS. 2 and 3) extends adjacent slot 31 on bolt 30 (FIGS. 2–6). As shown in FIG. 2, the spring is mounted in the housing just above bolt 30 (FIG. 2) and fits between bolt guide 32 and plate 33 (FIGS. 2 and 3). The bolt guide and plate prevent movement of the spring out of its correct position either through vibrations or by intentional attempted tampering with the spring as described hereinafter.

As shown in FIGS. 3, 4 and 5, spring 40 biases arm 41 into slot 31. The heat responsive means comprises a fuse 50 (FIGS. 3 and 4) mounted in fuse holder 51 on rear wall 11. The fuse urges spring 40 against its biasing to retain arm 41 out of slot 31. However, fuse 50 melts when heat above a predetermined temperature is applied to the housing, and the fuse can no longer hold the spring against the biasing so that the spring moves the arm into the slot. In the preferred exemplary embodiment, fuse 50 is made of lead or other low melting material. As long as it is maintained above its melting point, it holds spring 40 in the position shown in FIGS. 3 and 4 with arm 41 out of slot 31.

If an attempt is made to enter the case by way of drilling or by use of a cutting torch, heat will be transmitted through housing 10 to rear wall 11 and fuse holder 51. In the preferred exemplary embodiment, the fuse holder is formed integrally with the rear wall 11. However, to aid in heat transmission, fuse holder 51 could be formed of a metal having a high coefficient of heat transmission. It will be recognized that it is unnecessary that fuse 50 melt completely and flow out of fuse holder 51. Heat will initially soften fuse 50 such that the bias on spring 40 will indent the fuse sufficiently to allow arm 41 to enter slot 31.

Spring 40 includes a pair of legs interconnected at a bight portion and a third leg connected to one leg of the pair of legs at the end opposite the bight portion. As shown in the exemplary embodiment of FIGS. 4 and 5, spring 40 includes a pair of legs 42 and 43 connected at a bight portion 44. Thus, in the preferred exemplary embodiment, the spring is biased outward or toward increasing the angle between the pair of legs 42 and 43. It should be understood that the device could be constructed with a spring in tension by changing the position of the fuse and spring in a manner that is readily apparent from the teaching herein. In the exemplary construction, leg 42 rests against front wall 13 and is held from sliding along the wall by bolt guide 32 and plate 33 which holds the spring.

All three legs, 42, 43 and 45 are in the same plane (FIGS. 2 and 3). Third leg 45 is opposite bight portion 44 and intersects leg 43 adjacent fuse 50. Arm 41 is perpendicular to the plane of the legs, and the spring is configured such that the fuse positions the third leg so that the arm is adjacent the slot. When the fuse melts and leg 43 moves as bight 40 of the spring opens against its compression, the third leg 45 moves to position arm 41 in slot 31.

The manner in which the spring is configured and mounted in the housing is an important feature of the present invention because the spring occupies little room and yet it must be strong enough to ensure that when the case is heated, the spring will begin indenting fuse 50 so that arm 41 can enter slot 31 and provide an additional locking system for the lock. Moreover, the mounting prevents the spring from vibrating out of its correct position and eliminates the possibility that one could purposely vibrate the combination lock in an attempt to dislodge the spring.

Also important, by having the spring lie mainly between plate 33 and bolt guide 32, access to the spring from the area in the housing near the tumblers is difficult so that if one drilled or cut into the housing adjacent the tumblers to tamper with the tumblers, he could not reach spring 40 to release arm 41 from slot 31. Of course, the plate 33 could be shaped differently to provide complete protection for the spring.

A hole 36 may be provided in front wall 13 of housing 10 adjacent spring 40 for providing access to the spring so that a tool can be inserted through hole 36 to reach the spring to move the arm out of the slot. This feature allows the safe to be opened after the lock has been tampered with and the additional locking mechanism has locked. Typically, after one had drilled or cut into the housing and found that he was still unable to open the lock because of the additional locking mechanism, he would abandon his attempt at entering the safe. If he attempted to drill or cut a second hole to locate spring 40 in an attempt to defeat the additional locking mechanism, the additional time necessary to make a second hole may enable him to be discovered and captured. Moreover, the first cut or drilling is usually made at the weakest part of the housing adjacent shaft 12 where there is already a bore through door 16 and front wall 13. A second hole near hole 36 would have to go through a complete portion of door 16.

If the attempted safecracker is apprehended or abandons his attempt, and assuming that the additional locking mechanism had been tripped, the owner of the safe would have to cut through hole 36 to reach arm 41 and pull it out of slot 31 so that the bolt could be moved and the door opened.

Another important feature of the present device is the manner in which arm 41 is released from slot 31 during assembly of the combination lock. The lock housing is usually a casting formed of a main casting 27 consisting of front wall 13, sidewalls 12 and 14, and top and bottom walls 24 and 25. The rear wall 11 is a separate piece. After all of the parts are assembled in main casting 27, the rear wall is fastened to the main casting. As set forth above, fuse 50 is mounted on rear wall 11 and is positioned such that when the rear wall 11 is fastened to the main casting, the fuse 50 pushes on leg 43 at spring 40 moving arm 41 out of slot 31. Thus, once rear wall 11 is fastened to the main casting, the additional locking mechanism is set in its FIGS. 3 and 4 position ready to provide an additional locking system for the combination lock in case the housing is subjected to heat.

The present invention also includes a method of providing additional locking for a combination lock. The spring is biased in the lock toward the bolt such that when the spring is in the bolt, the bolt is prevented from moving. The spring is forced out of the bolt by a fuse whereby when the fuse is subjected to at least a predetermined temperature and melts, the fuse releases the spring to allow it to enter the bolt.

Thus, a combination lock with an improved additional locking mechanism has been disclosed. All of the aforementioned objects have been met and additional ones have been made evident by the description of the invention. Various modifications and changes may be made in the configuration described above. All changes and modifications coming within the scope of the appended claims are embraced hereby.

I claim:

1. In a combination lock having a housing, a locking mechanism, a bolt in the housing movable between a first position projecting out of the housing and a second position generally withdrawn in the housing, means for moving the bolt to the second position only when the locking mechanism is in an unlocked condition, the improvement comprising:

additional locking means in the housing for locking the bolt in the first position and heat responsive means for preventing the additional locking means from locking the bolt until the housing is heated above a predetermined temperature, the additional locking means comprises a spring mounted in the housing, the spring having an arm thereon and a pair of legs interconnected at a bight portion and a third leg connected to one leg of the pair of legs at the end opposite the bight portion, the arm depending from the third leg, the bolt having a slot therein, means in the housing for mounting the spring such that the arm is adjacent the slot, the spring biasing the arm into the slot, the heat responsive means comprising a fuse in the housing for urging the spring against the biasing to retain the arm out of the slot whereby when the fuse is melted when heat above the predetermined temperature is applied to the housing, the fuse no longer urges the spring against the biasing so that the spring can move the arm into the slot.

2. The improvement of claim 1 wherein the three legs are in the same plane and the arm is in a plane perpendicular to the plane of the legs, one leg of the pair of legs being secured in the housing, the other leg of the pair of legs contacting the fuse, the spring being biased against the fuse and positioning the third leg such that the arm is adjacent the slot, whereby when the fuse melts, the other leg of the pair of legs is free to move so that the third leg can move to position the arm in the slot.

3. The improvement of claim 2 wherein the legs are in a plane parallel to the direction of travel of the bolt.

4. The improvement of claim 1 further comprising guard means in the housing around the spring to prevent the spring from being removed from the position with the arm adjacent the slot.

5. The improvement of claim 1 further comprising a hole through the housing adjacent the spring for providing access to the spring so that a tool can be inserted through the hole to reach the spring to move the arm out of the slot.

6. The improvement of claim 1 wherein the housing includes a removable rear wall to provide access to the housing interior, fuse mounting means on the rear wall for mounting the fuse such that the fuse contacts the spring to move the leg out of the slot when the rear wall is secured to the housing.

* * * * *